US009157705B1

(12) United States Patent
Majerus et al.

(10) Patent No.: US 9,157,705 B1
(45) Date of Patent: Oct. 13, 2015

(54) PROJECTOR FOR DEFEATING BURIED MINES

(71) Applicants: Mark E. Majerus, Middletown, DE (US); Richard L. Vanaman, West Orange, NJ (US); William J. Bergeria, Montclair, NJ (US)

(72) Inventors: Mark E. Majerus, Middletown, DE (US); Richard L. Vanaman, West Orange, NJ (US); William J. Bergeria, Montclair, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 217 days.

(21) Appl. No.: 13/905,714

(22) Filed: May 30, 2013

(51) Int. Cl.
*F41H 11/12* (2011.01)

(52) U.S. Cl.
CPC ..... *F41H 11/12* (2013.01)

(58) Field of Classification Search
CPC ..... F41H 11/12; F41H 11/14; F41H 11/16; F41H 11/18
USPC ..... 89/1.13; 102/402, 403
See application file for complete search history.

(56) References Cited

U.S. PATENT DOCUMENTS

| | | | | |
|---|---|---|---|---|
| 6,363,828 | B1 * | 4/2002 | Sherlock et al. | 89/1.13 |
| 6,453,788 | B1 * | 9/2002 | Lebet et al. | 86/50 |
| 6,546,838 | B2 * | 4/2003 | Zavitsanos et al. | 89/1.13 |
| 2005/0081706 | A1 * | 4/2005 | Alford | 89/1.13 |

FOREIGN PATENT DOCUMENTS

| | | | |
|---|---|---|---|
| GB | 2 259 971 | A * | 3/1993 |
| WO | WO 2005/078375 | A1 * | 8/2005 |

* cited by examiner

*Primary Examiner* — Stephen M Johnson
(74) *Attorney, Agent, or Firm* — Henry S. Goldfine

(57) ABSTRACT

An relatively small anti-personnel mine device having a housing about 2 to about 3 inches in diameter, by about 2 to about 4 inches in length, which device projects a dispersion pattern of ⅛ to ⅜ inch diameter hard fragments over at least a 3 to 4 inch radius circle to neutralize a typical, buried, anti-personnel mine. The device contains about 125 to 190 grams of plastic explosive, which when detonated impacts a gas push plate against which an array of the fragments are lodged—the gas push plate and the fragments being encased in a puck shaped matrix of plastic or resin. The effect of the device is such that in addition to neutralizing the mine, the overburden atop the buried mine is expelled exposing the mine, providing enhanced safety in removal and a warning if the mine is daisy-chained to other mines.

18 Claims, 6 Drawing Sheets

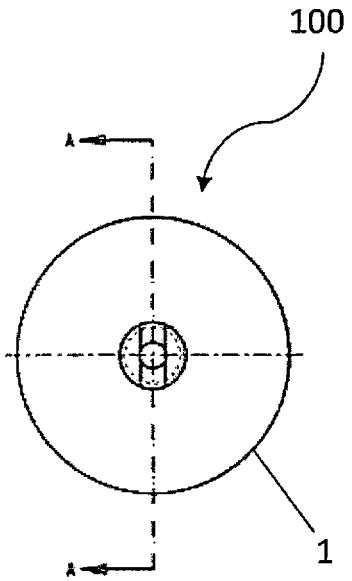
Fig. 3a
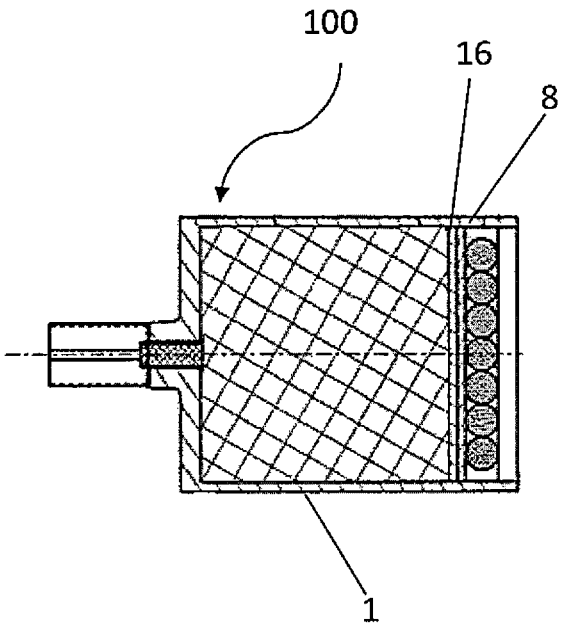
Fig. 3b
Fig. 3

PROJECTOR FOR DEFEATING BURIED MINES

STATEMENT OF GOVERNMENT INTEREST

The invention described herein may be manufactured, used, imported, sold, and/or licensed by or for the Government of the United States of America for U.S. Government purposes, without the payment or any royalty thereon or therefore.

BACKGROUND OF THE INVENTION

1. Field of the Invention

The present invention relates to an anti-mine system capable of effectively neutralizing buried mines, and in particular, to such a system which is readily portable and can easily positioned by small to medium scale robots to defeat buried anti-personnel.

2. Description of the Related Art

While buried land mines were first developed in the late $19^{th}$ century and became widely used in WWI, during the early $20^{th}$ century, an effective system to disable them has proven elusive—as the earth within which they are buried provides significant protection thereof. This difficulty in disabling such devices has been complicated with advances in the technology of the mines themselves; such as, blast resistant fusing, anti-handling features, and anti-tampering features.

In general, mine clearing, or breaching, during combat operations is conducted at a rapid operational tempo, and may be accomplished by using mine rollers or flails which either activate the mine's fuzing or damage the mine to the point where it will not function and detonate. Another option used has been to detonate bulk explosive charges on or over a known or potential minefield; which detonation creates a spike in pressure that is often sufficient to trigger a detoration of simple pressure fuzed mines. If the explosive charge is large enough, or is in sufficiently close proximity to the mine, the pressure spike may be sufficient to sympathetically decorate a mine. These techniques are usually employed over a broad area when individual mines' locations have not been identified. However, advances in mine technology have produced blast resistant mines; which have fuzes that are largely immune to being triggered by the brief pressure wave of a nearby bulk charge and require the more sustained pressure of a person or vehicle to detonate.

In non-combat situations, mine clearing is conducted at a slower tempo, primarily due to humanitarian concerns, such mine clearing is known as demining, and often involves the locating and neutralization of all individual mines in a given area. The most reliable approach to demining is to layout a search grid and manually probed each grid point to find all possible threats; however, this is very manpower intensive and time consuming. Alternative means of locating mines have been developed which are somewhat faster, such as using metal detectors and ground penetrating radar. However, such alternative detection equipment has a halo of uncertainty, wherein the mine itself may be within a given radius vs. the exact spot that the equipment is indicating. In general, within an approximately an 8 inch diameter circle about the detectors point of focus is considered a standard halo of uncertainty.

While the use of mine detection equipment greatly improved the rate at which demining could be accomplished, personnel still usually needed to remove the soil overfill material from over the mine to either manually disable the mine, or by any number of other means, including using a pyrotechnic torches, shaped charges or chemical means, disable the fuze or consume the explosive without it detonating. Or, alternatively, by simply placing a block of demolition charge in direct contact with the mine—trigger the fuze, or cause a sympathetic detonation of the explosive in the mine (and potentially other mines in the area—which may be dangerous to individuals in the vicinity). Further, these method's generally require the mine's footprint to be positively ascertained, since pyrotechnic torches, shaped charge, or chemical means generally have a single vector of attack, which is limited in cross-section. Also, the effectiveness of bulk charges in sympathetically detonating a mine greatly decreases with the distance from the mine—as the increased amount of overfill material dampens the pressure wave. However, the limits of current detection equipment do not allow the precise determination of the mine footprint; but, only the location of the mine within the 4 inch radius halo of uncertainty. Ensuring that a single vector defeat method contacts a buried mine within this halo is substantially more problematic in the case of small anti-personnel mines, which can be as small as 2 inches in diameter.

U.S. Pat. Nos. 6,298,763 and 7,182,011, utilize an explosively dart or plurality of darts that travel parallel to each other, downwardly to neutralize a mine. However, these darts in so traveling downwardly, perpendicular to face of the device, are limited in that they impact only a mine directly below the face of the device. Therefore, unless the device has a face large enough to cover the halo of uncertainty, or if the mine is located directly under the face—the device will fail to neutralize the mine.

An alternative anti-mine device is taught in U.S. Pat. No. 6,155,155. This device projects shattered fragments from a fragmentation component, to penetrate the overburden and neutralize the mines. However, such irregular fragments produced by such a device would not effectively penetrate the overfill/overburden, and the device would have to be very large and heavy—to realize the desired effect.

Robotic platforms, robots, have been increasingly deployed in demining operations to remove all humans from the danger zone. Increasingly, robots of this type have been created that are smaller and more portable. Due to the emergence of increased usage of such smaller robotics in the demining mission, a neutralization tool deployed from such a robot must not exceed its limited payload capability; but, still cover the halo of uncertainty.

Therefore, it can be seen that there is a need in the art for a device small and light enough to be utilized by small to medium scale robotic in demining operations; but, which has the penetrating power to penetrate the overfill and effectively and totally neutralize buried mines within the entire halo of uncertainty, even mines of the blast resistant variety.

SUMMARY OF THE INVENTION

The present invention addresses the above stated needs by providing an anti-mine device which projects a dispersion pattern of fragments to cover at least a 3 to 4 inch radius (6 to 8 inch diameter) circle for neutralizing antipersonnel mines, the device being contained within a cylindrical canister, i.e. a generally tubular housing, which has an open front end opposed to a rear end; wherein the bulk of the canister or housing, extending from the rear end toward the open front, is filled with about 125 to about 190 grams of a generally cylindrical mass of explosive, preferably a plastic explosive, such as C4, PE4, Semtex, or the like; the generally cylindrical mass of explosive having a rear end adjacent to the rear end of the tubular housing and a front end, proximate to the open front end of the generally cylindrical housing; wherein, there is a is a generally circular gas check plate having a rear side located adjacent to the front end of the generally cylindrical mass of explosive, and a front side located more proximate to the open front end of the tubular housing; and where there are a plurality of generally spherical hard fragments located adjacent to the front end of the gas check plate; wherein the fragments and the check plate are encased in a matrix formed of a plastic, preferably an epoxy, or a resin, or similar material; which matrix is in the form of a puck having a diameter such that it force fits within the inner diameter of the tubular housing. The rear end of the housing is closed; except, for a channel or other means by which an initiator, i.e. a detonator, is connected; which initiator contacts the explosive proximate to the rear end of the housing, thereby providing a means to initiate the detonation of that explosive. In operation, the open front end of the housing is aligned with the location, or suspected location, of a mine; such that, when the mass of explosive is initiated, the detonation thereof will vaporize, or fracture the gas check plate into very small fragments, and the spherical fragments located adjacent thereto, will be driven into the overburden, over a relatively wide pattern, to effectively and totally neutralize any mine within that pattern. Further, due to the relatively limited size and explosive effect of the present invention, its detonation will minimize the likelihood of causing a sympathetic detonation of any other nearby mines.

In a preferred embodiment of the present invention, the generally tubular housing described above can be from approximately about 2 to about 3 inches in diameter, and preferably from approximately about 2 to about 4 inches in length, so as to be easily emplaced over a mine by hand or so positioned by use of a robot. The gas check plate, mentioned above as being contained within a matrix formed of a plastic, preferably an epoxy, or a resin, or similar material, may be preferably be a flat sheet of metal with opposed flat ends, preferably of aluminum or copper. In an alternative embodiment, the gas check plate may be curved, i.e. having opposed curved ends, with substantively the same curvature, which may be curved convexly away from the explosive. In the event that the gas check plate is flat, the matrix which encases it and the mentioned plurality of spherical hard fragments will be generally cylindrical in shape, with opposed flat ends, so as generally to be in the form of a puck. However, in the event that the gas check plate is curved, the front end of the generally cylindrical mass of explosive will have a curvature which matches that of the check plate, such that the front end of the generally cylindrical mass of explosive will intimately lodge against the matrix which encases the curved check plate—the check plate thereby being lodged very closely to the front end of the generally cylindrical mass of explosive.

Further, preferably, the tubular housing of the present invention may have support means consisting of three or more legs which extend from near the end of the tubular housing proximate to the open front end thereof, such that the tubular housing can be placed on the extended legs and thereby positioned over the mine regarding which it is intended to neutralize. These legs should provide a standoff over the mine, such that the open end of the housing is at least 3 to 4 inches over the mine, preferably from 5 to 10 inches.

The generally spherical hard fragments, useful within the subject invention, are each from about ⅛ to about ⅜ inches in diameter, preferably about ¼ in diameter, should be packed closely together against the side of the gas check plate most proximate thereto. The fragments can be arranged in one, two, or three layers—preferably one layer, with from about 40 to about 70 fragments, more preferably about 45 to 60 fragments, more preferably 45 to 55, most preferably 45 to 50—and as stated above, held in place by being encased in a matrix of a polymeric or similar material. The quantity and quality of explosive should be such as to be capable of forcing the fragments at least about 2.5, preferably at least about 3 to about 5 inches, into the overburden or overfill (i.e. the soil, sand, clay or other earth material) within which a mine may be buried and still possess sufficient force to neutralize the mine itself. The diameter of the open front of the tubular housing, the positioning of the housing in relationship to the mine, the configuration of the push plate, and the packing of the spherical fragments all should provide a shot pattern of fragments which is sufficiently dispersed to cover a halo of uncertainty of at least about 3 to 4 inches in radius, within which of a typical anti-personnel mine may be located, and wherein the fragments should not interfere one with the next. Further, the velocity imparted to the fragments must be such as not to cause the fragments to penetrate by hydrodynamic process, which will not cause the fragments to erode, or to spall, which effects result in substantial, diminished penetration and failure to penetrate to and disrupt the mine.

Again, the quantity and quality of the explosive needed to impart a sufficient velocity to the spherical hard fragments to achieve the necessary force to neutralize the mine—but, less than that which would cause hydrodynamic penetration of the soil is a critical. This quantity is also important to avoid that the detonation of the inventive anti-mine device will sympathetically detonate any other nearby mines, including such that may be pressure sensitive. It has been found that packing C4 explosive or similar plastic explosive into the subject canister or tubular housing, about 125 to about 190 grams of explosive, and positioning this housing at least about 3 to 4 inches above the center of a mine, has been found effective in achieving the desired penetration and neutralization effects—without creating a shock wave that will sympathetically detonate any nearby mines. Further, and surprisingly, the overburden has been expelled by such a charge that neutralizes the mine therein, eliminating the need to subsequently uncover the disabled mine. This expelling of the overburden can be extremely helpful, as it allows a clear view of the mine for analysis from a robotic platform, and subsequently for safe removal with minimal probing and handling. And, importantly, a clear view of the mine may uncover any daisy-chain to other mines—which is always a potential threat.

Additional aspects of the invention will be set forth in part in the description which follows, and in part will be obvious from the description. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated herein and constitute part of the specification, illustrate an embodiment of the invention and together with the description, serve to explain the principles of the present invention. The embodiments illustrated herein are presently preferred, it being understood, however, that the invention is not limited to the precise arrangements and instrumentalities shown, wherein:

FIG. 3 shows a first image, FIG. 3*a*, which is a top view of an anti-mine device of the present invention, and a second image, FIG. 3*b*, which is a cross-sectional view looking along the cut made along line A-A, as indicated by the arrows.

DETAILED DESCRIPTION OF THE INVENTION

Figure 1:
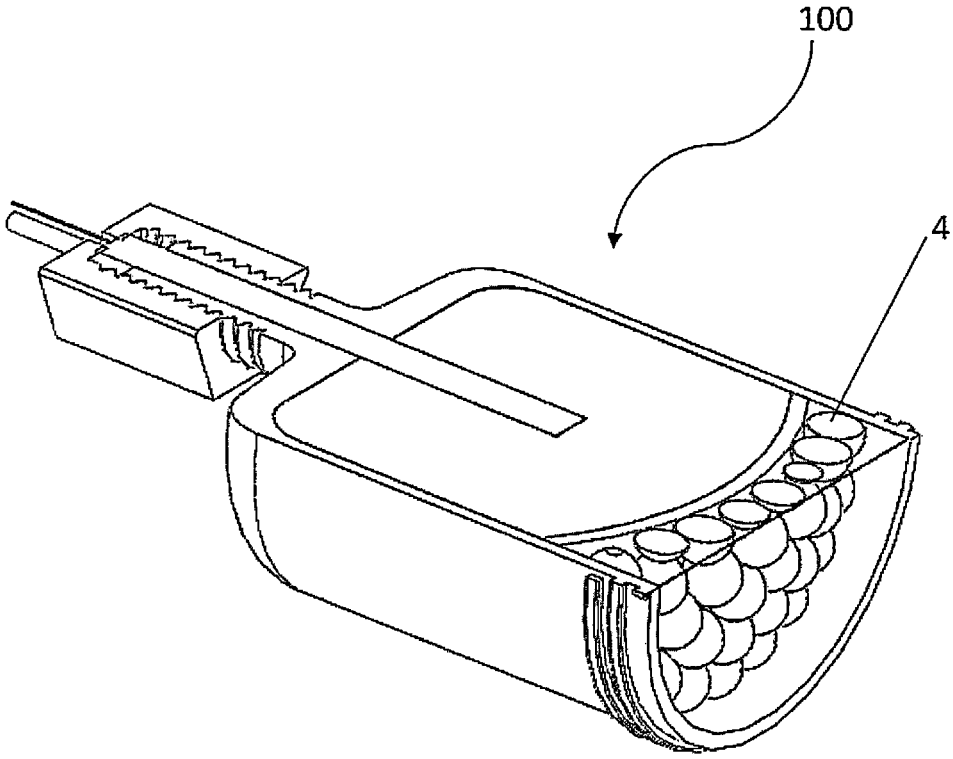
FIG. 1 is an illustrative embodiment of an anti-mine of the present invention, showing a cut-away view perspective view of the invention.

The invention, as embodied and described herein, and as shown in cut-away view in FIG. 1, is an explosively driven, fragment projecting anti-mine device (100), used for projecting an array of hard, spherical fragments (4), at a velocity within a specific range, over a specific area and through overfill (i.e. overburden) material, to effectively neutralize a buried anti-personnel mine, or other type of mine—wherein the relatively small and hard fragments do not spall, and wherein the size of the subject invention and quantity of explosive therein is such as to minimize and sympathetic explosions of other nearby mines. Further, the subject invention, as discussed herein, also surprisingly, blows the overburden from over the mine—to reveal it and aid in its safe removal.

Figure 2:
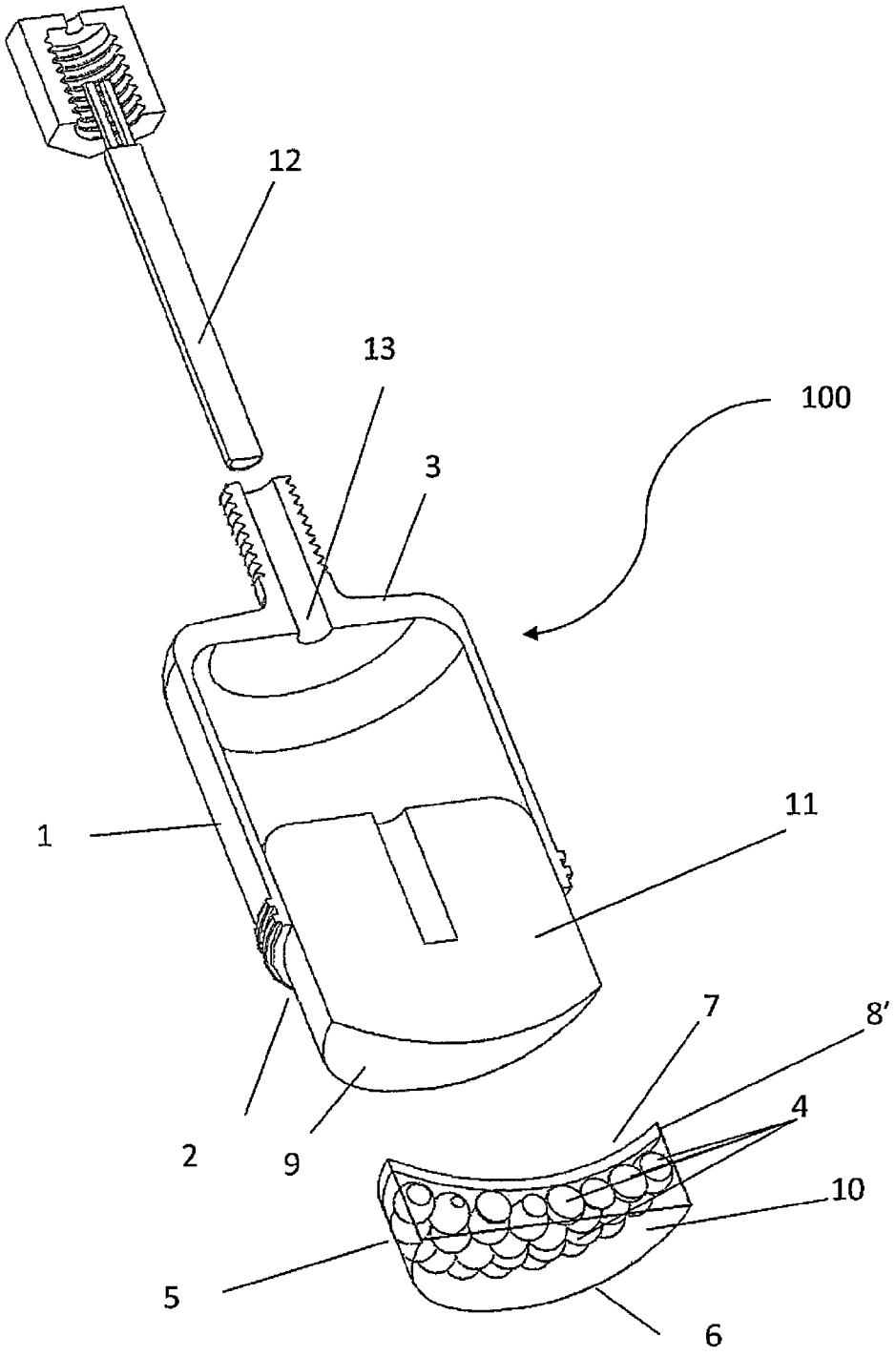
FIG. 2 is an exploded cut-away view of an embodiment of the present invention with curved puck shown, and where a well has been provided within the mass of explosive for an initiator to lodge into explosive.

Referring to FIG. 2, an anti-mine fragment projecting device of the present invention (100), comprising a tubular housing (1) having an open end (2) and a closed end (3), a puck (5), which is a polymer matrix having a front side (6) and a back side (7), which is located within the housing (1), proximate to and substantially occludes the open end (2) thereof, with the front side (6) of the puck (5) facing outward of the tubular housing (I), and which puck (5) contains an array of spherical fragments (4) in a generally disc arrangement within the puck (5), with said spherical fragments (4) held in this arrangement by a matrix (10) of material such as epoxy, a gas check plate (8') is part of the puck (5) and is affixed over substantially the entire back side (7), an explosive (11) material is retained within the tubular housing (1) adjacent to the back side (7) of the puck (5), initiating means (12) for the explosive (11) material, and an aperture (13) in the closed end (3) to receive said initiation means (12). In the preferred embodiment, the spherical fragments (4) are about ⅛ to ⅜ inches in diameter, and the puck contains preferably about 45 to about 55 spherical fragments (4).

In a preferred embodiment of the present invention, the tubular housing (1) may be made of numerous frangible materials such as plastic, phenolic, fiberglass, plaster, rubber, foam, paper, cardboard, wood, fiber-board, polyoxybenzilmethylenglycolanhydride, reinforced resins, or ceramics. Other materials may be suitable for construction and are well known to those in the art. A metallic housing should be avoided, however, as it would scatter metallic fragments over a wide area which would cause additional ground clutter for mine detection systems. As detailed above, the housing may be comprised of a generally cylindrical or tubular body with an open end (2) and a closed end (3).

In an alternate embodiment of the present invention, the tubular housing (1) may have another second open end (2) rather than a closed end (3), and in such a case, a separate end cap may be affixed to the second open end (2). The end cap may be joined to the tubular housing (1) by being screwed thereon or glued thereto using known methods.

The dimensions may vary somewhat, but in order to accommodate a preferred disc array of about 45 to about 55 spherical fragments (4), each about ⅛ to about ⅜ inches in diameter (most preferably about % inch in diameter), a tubular housing (1) having an inner diameter of preferably at least approximately about 1.75 to about 2 inches. In order to provide sufficient volume for the puck (5), and sufficient explosive to impart the desired velocity to the afore mentioned spherical fragments (4), the tubular housing (1) may be about 2 to about 4 inches in length, preferably approximately about 2.5 inches long. An aperture, or relatively small hole, is formed within closed end (3), or the end cap, in order to insert the initiating means (12) discussed below.

Figure 5:
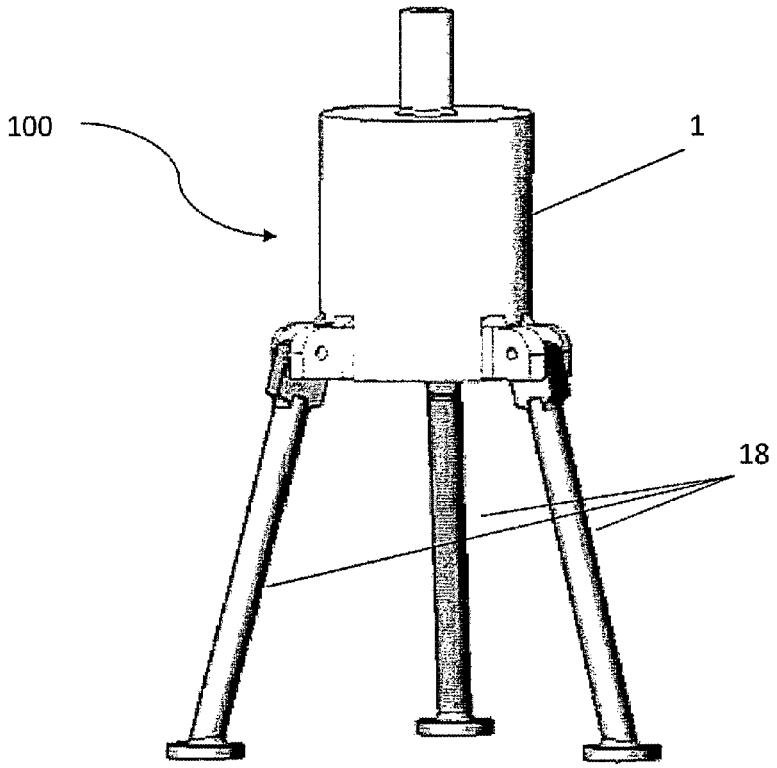
FIG. 5 is an embodiment of the invention with integral folding legs, which are shown extended.

As shown in FIG. 5, the housing may also be designed to rest on, be attached to or have integral mounting means, such as a tripod set of legs (18), or a connection to attach the housing (1) to an external munition stand or other mount. These mounting means or other means may be use to suspend the housing (1) at the desired standoff height above the ground or overburden, wherein a suspected mine is located. Additionally, the housing (1) may also be designed to have integral or provisions for attaching aiming sights. Such mounting means or aiming features are known to those in the art.

In a preferred alternative of the present invention, again referring to FIG. 2, the puck (5) preferably is of a diameter with respect to the inside diameter of the tubular housing (1), such that it is a force fit therein thru the open end (2) thereof, such that the puck (5) will maintain a position within the tubular housing (1), once it is forced or pushed into the desired location within the tubular housing (1) thru the open end (2) thereof. The puck (5) is so forced into the tubular housing (1) to the point where it contacts the explosive (11) therein. In the preferred embodiment, the puck (5) contains a plurality of pre-formed, generally spherical fragments (4) of hard material, in an array which may be either generally planar (i.e. flat), or, advantageously, generally convex in the outwardly facing direction; such that the gas check plate (8') that forms the interface between the explosive (11) and the generally hard spherical fragments (4), both preferably bow out, i.e. bow away, from the explosive (11) and toward the open end (2) of the tubular housing (1).

After the explosive (11) of the present invention is initiated and detonates, the hard spherical fragments (4) of the present invention are driven to perforate the ground overburden, and any mine therein, to cause structural and operative failure of the mine and render it inoperative. As detailed herein, the number of fragments, fragment size, fragment material, etc are designed for a general coverage area with respect to standard the mine sizes and mine burial depth, and general types of overburden material. The fragments (4) should be made of a hard durable material, so as to be able to withstand the launch/acceleration forces and be able to penetrate the overfill, or overburden, as rigid-bodies—launch/acceleration forces which lead to a velocity of up to about 1,400 meters/second. While the fragments (4) may be made of steel or brass or other metal or alloy thereof, the most preferred material is tungsten-carbide. As a tungsten carbide fragment pattern, from an anti-mine device (100) of the present invention, is easily discernible in the overburden from other soil discontinuities caused by pressure plates, artillery shells and landmines, as detected by Ground Penetrating Radar metal detectors which are in use. Further, as stated above, surprisingly, the overburden is expelled or significantly blow-away over the mine, exposing the mine, due to the action of the hard spherical fragments (4) projected by the anti-mine device (100) of the present invention.

Given the projection velocity of the generally spherical hard fragments (4) of the present invention, between approximately 500-1400 meters/second, the spherical fragments (4) can penetrate approximately 10-20 times their own diameter of a variety of overfill materials; thus, such fragments with a diameter of about 0.25 inches, can penetrate 2.5 to 5 inches into the overburden and still have enough force/momentum to penetrate and disable an anti-personnel mine. In most cases, such a penetration of from about 2.5 to about 5 inches is the minimum penetration necessary to neutralize an anti-personnel mine buried under about 2 inches of overfill/overburden.

Generally, harder spherical fragments have been found to be more susceptible to spalling, as a result of the shock from the explosion; especially, as the fragment diameter increases. This was found to be the case in earlier versions of the M18 Claymore, where explosively driven hardened steel balls of about % inch in diameter spalled into fragments and so performed very poorly. Therefore, it was surprising to establish that the most preferred ¼ inch spherical fragments (4) of the present invention, manufactured of hard tungsten carbide material, performed very well in the present application, without any significant spalling.

Further, the spherical projectiles of the present invention provided much better and more predictable penetration for a given fragment mass, than for instance, an irregular fragmentation component as described in U.S. Pat. No. 6,155,155. The irregular fragments did not penetrate as efficiently into the overfill, such that any anti-mine device using such irregular fragments would have to be substantially larger than the present invention to achieve an equivalent effect. Further, the generally spherical fragments of the current invention are superior to darts, as described in U.S. Pat. No. 7,726,244, as the darts require proper orientation for good penetration; which is difficult do achieve over the desired, short standoff ranges, without larger, more: complex devices, such as described in U.S. Pat. No. 6,298,763.

Notwithstanding the spalling issue, discussed above, larger projectiles may penetrate further. However, if a given device size is assumed, a smaller number of larger projectiles will not sufficiently blanket the target area with a dense enough cluster of fragments to obtain a high probability of hitting a small anti-personnel mine, which can be as small as 2 inches in diameter. Conversely, if one were to make the spread of fragments too dense, surprisingly, it negatively affects the penetration of the fragments through the overfill material. Fragments penetrating too closely will interfere with each other as the soil overfill does not have sufficient room to move out of the way, resulting in a "traffic jam" like degradation in penetration performance. It has been observed that approximately 40 to 55, more preferably 40 to 50; preferably, roughly ¼ inch diameter projectiles; projected over a 4 to 6 inch radius area (8 to 12 inches in diameter)—both provided a high probability of impacting a buried 3"diameter anti-personnel mine with a plurality of fragments (4), while sufficiently distributing the fragments (4) to prevent mutual interference during penetration of the overfill.

Figure 6:
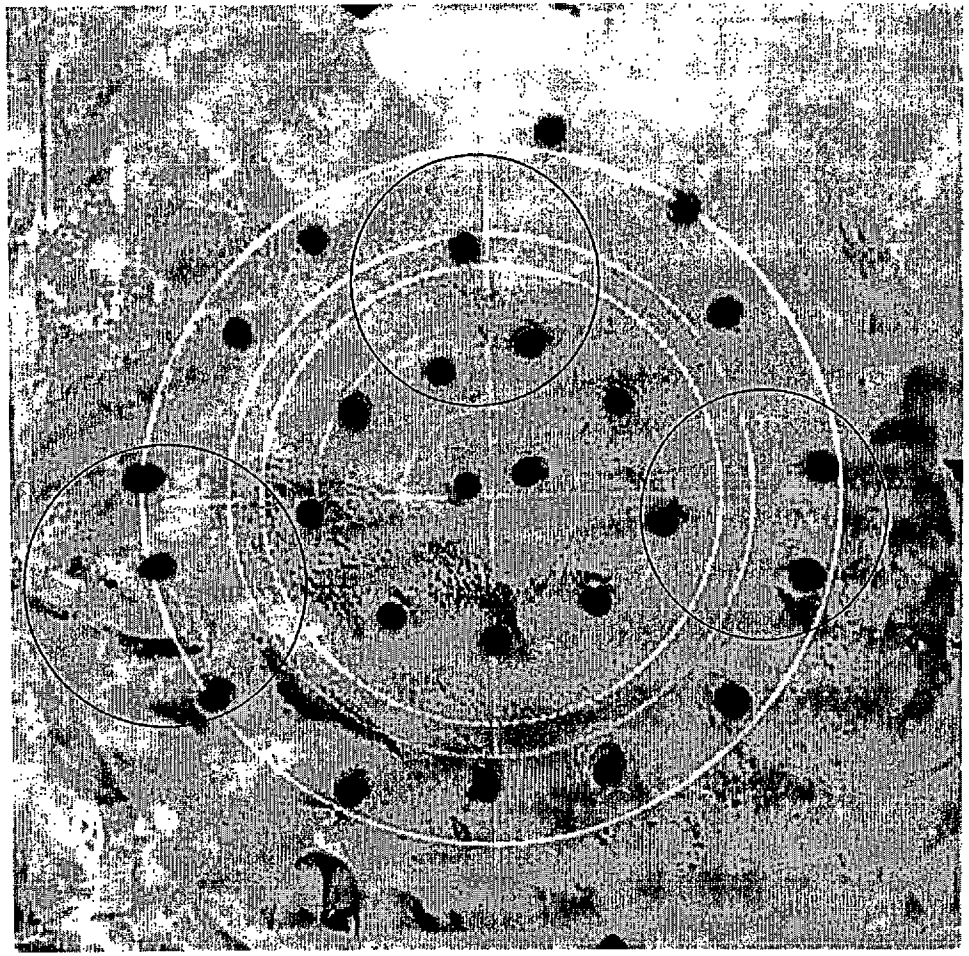
FIG. 6 is a depiction of a test sheet of copper buried under 2 inches of overfill—which was subjected to being bombarded by spherical hard fragments discharged from an anti-mine device of the present invention.

The effectiveness of an anti-mine device (100) of the present invention is illustrated in FIG. 6—which depictions of a test sheet of copper buried under 2 inches of overfill—which test sheet was subjected to being bombarded by spherical hard fragments discharged from an anti-mine device (100) of the present invention; wherein, the outer circle depicts extent of the 4 inch radius of uncertainty (8 inch diameter circle), and the 3 non-concentric circles are overlaid as examples of 3 inch anti-personnel mine footprints. 26 fragments can be seen to have penetrated and substantially uniformly cover the area of uncertainty—and, as can also be seen, at least 3 fragments impacted and penetrated the 3 non-concentric circles representing randomly placed anti-personnel mines. Impact with such a plurality of fragments (4) has led to the acceptable neutralization of the tested mines; however, recent testing has shown that even impact by a single fragment may be sufficient to neutralize an anti-personnel mine. Thus to minimize the size and weight of the present anti-mine device (100), while providing a suitable density of projectiles to penetrate each mine with 3 or more fragments (4), to neutralize anti-personnel mines (generally, about 2 inch and larger diameter mines buried under 2 inches of overfill), an embodiment of the present anti-mine device (100) with approximately 45 to 50 generally spherical hard fragments (4), which are ¼ inches in diameter is preferred.

Further, in the present invention, all of the generally spherical hard fragments (4) do not need to, and will not, penetrate to the same depth. As the pattern of fragments (4) spreads, the outer peripheral fragments (4) of the array will be traveling at an angle, i.e. on the diagonal, meaning they essentially travel through more overburden to reach a given depth, and accordingly, will become spent at a somewhat shallower depth. However, the outer fragments (4) advantageously achieve a wider spread and thus act to defeat mines at the outer fringe of the desired 4 inch radius halo of uncertainty, at such shallower depths.

The generally spherical hard fragments (4) of the present invention are held in the required geometry by a matrix (10) of material such as a plastic, preferably an epoxy, or a resin—similarly to how the ⅛ inch soft steel balls of an M18A1 Claymore mine are embedded in steel filled epoxy. As detailed above, the matrix (10) material of the present invention holds the generally spherical hard fragments (4) and the gas check plate (8) together in the form of a puck (5), where the gas check plate (8) comprises substantially the entire back side (7) of the puck (5), between the fragments (4) and the explosive (11).

The gas check plate (8) of the present invention serves to briefly entrap the explosive gases to increase the energy imparted to the fragments (4). The gas check plate (8) may be manufactured of a material such as aluminum or copper or similar. Although made of metal, the gas check plate (8) vaporizes, or fractures into very small fragments, upon device detonation, and residual material therefrom does not contribute to false alarms during follow-up mine detector sweeps. In the preferred embodiment, the gas check plate (8) is made of aluminum and may be preferably about 0.07 to about 0.08 inches thick.

Optionally, as shown in FIG. 3*b*, in additional to the gas check plate (8) (in this case a flat gas check plate is illustrated), an additional layer, or layers, of material may also be included between the explosive (11) and the fragments (4) in the form of a shock attenuation buffer (16). Such a shock attenuation buffer (16) may manufactured of a plastic, such as polystyrene, or similar material, which may be arranged and/or selected to decrease the strength of the explosive shock wave, to thereby promote the structural integrity of the fragments (4). This shock attenuation buffer (16), is similar to the polystyrene spacer in U.S. Pat. No. 7,182,011B2, or U.S. Pat. No. 6,363,828, which spacer works to mitigate shock load. In an alternate embodiment the material of the gas check plate (8) may be selected to perform the functions of both the gas check plate and shock attenuation buffer.

Figure 4:
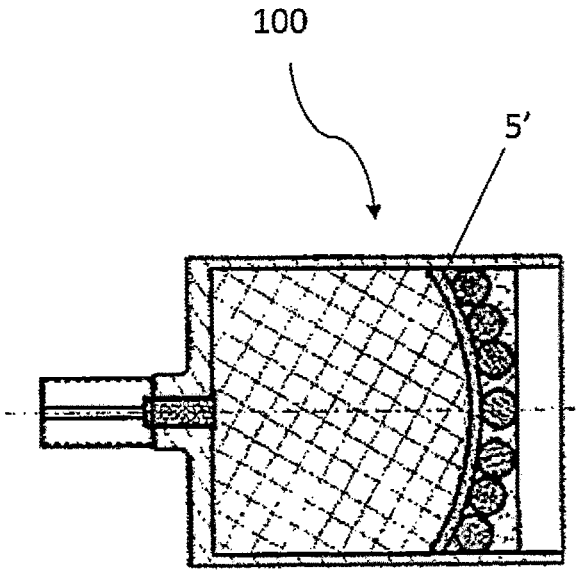
FIG. 4 is a cross-sectional side view of an anti-mine device of the present invention, similar to FIG. 3*b*, but without the optional shock attenuation buffer and with a curved gas check plate and corresponding curved array of generally spherical hard fragments nested thereagainst within the puck.

As discussed above, the array of fragments (4), gas check plate (8), plus the optional shock attenuation buffer (16), are preferably all integrated into the puck (5), which as mentioned above and shown in FIG. 3*b* may be flat; the flat gas check plate (8) helping to facilitate ease of construction. Or, advantageously to enhance the area of overburden penetrated by the spherical harc fragments, as shown in FIG. 4, a curved gas check plate (8') may be used (contained within a puck having a correspondingly curved rear end)—which curved gas check plate (8') and enclosing puck (5') is oriented in a convex manner with respect to the explosive (11). Both flat and curved puck designs can provide similar levels of penetration performance; however, as stated the curved puck (5'), shown in FIG. 4, generates a similar dispersion pattern with half of the standoff of the flat puck (5), shown in FIG. 3. So, with a flat gas check plate and a 10 inch standoff, the 8-inch diameter uncertainty region was filled with fragment impacts. However, using the curved gas check plate (8') and correspondingly curved puck (5'), similar fragment coverage was realized with a 5 inch standoff. If a curved gas check plate (8') and puck (5') is to be used in a preferred embodiment, the curved gas check plate (8') may be constructed have a curvature approximately corresponding to about a 1.7 to 1.8 inch radius.

In a preferred embodiment of the present invention, the puck (5) may be manufactured by several alternate means. A simple fabrication method, which may be suitable for fabrication at the depot level may include inserting the gas check plate (8) in the appropriate orientation in a sacrificial cylindrical mold of approximately the same diameter as the gas check plate, covering the gas check plate (8) with an array of spherical fragments (4), filling the mold with epoxy, or other plastic material, or a resin, to more than cover the spheres, allowing the plastic or resin to cure, extract the assembly from the mold, milling or otherwise removing any surface imperfections to obtain a smooth surface about the puck (5). The particular epoxy or other plastic material or resin may be clear or opaque.

As generally shown in FIG. 2, and discussed above, the explosive (11) is pressed into the interior of the tubular housing (1) so that it occupies the majority of the space therein and is proximate to the closed end (3). The puck (5) is then inserted, so that the back side (7) is intimately in contact with the explosive surface (9). A plastic explosive, such as composition C-4 upon detonation imparted the desired velocity, without any spalling of the hard spherical fragments (4), which fragments penetrated the overburden, penetrated any anti-personnel mine therein and disable it. Similar plastic explosives such as PE4, Semtex, or the like, are also useful in the current invention. However care must be taken that an alternate explosive and quantity of that explosive not result in a higher particle velocity which pushes past the hydrodynamic limit, or a lower particle velocity that is not sufficient to penetrate the overburden, or cause an excessive shock loading on the spherical fragments which may cause them to spall.

The subject inventive anti-mine device may be provided fully assembled, or as inert parts in kit form (no explosive or hazardous material included, to simplifying shipment), with the explosive to be loaded from available supplies in the operational environment, on site, prior to use or deployment. This also precludes the cost, delay and overall necessity of qualifying an energetic component. Whether the explosive is loaded in a manufacturing environment or in the operational environment, the explosive should be pressed into the tubular housing (1) so that the surface of the explosive (9) that is proximate to the puck (5) is substantially in the same shape as the back side (7) of the puck (5), ensuring that no void forms in the pressed explosive. (See, FIG. 2) This can be accomplished with an appropriately shaped plug or press which may be machine operated, or may be attached to a manually operated pressing mechanism, or the press may be used by hand. Good results may be achieved by pressing the explosive in approximately 25 gram increments and with the final portion pressed into place with a plug shaped corresponding to the back of the puck (5).

The amount of explosive in the present invention is critical, since it governs the velocity of the fragments (4), which must be kept within the 500-1400 m/s range. If excessive explosive is used, the excessive velocity of the fragments (4) will cause them to penetrate hydro-dynamically, rather than as rigid bodies, which will substantially degrade the penetration performance of the fragments (4) through the overfill material. In the preferred embodiment, a total of 125-190, preferably 150 to 190, more preferably, 170 to 190 grams of C4 explosive should propel the most preferred approximately 45 to 50, each most preferably about ¼ inch generally spherical tungsten carbide fragment projectiles (4) at this velocity range. A most preferable quantity of about 180 to 185 grams of C4 should propel these projectiles at an optimal velocity to maximize rigid body penetration distance.

As shown in FIGS. 2, 4, 5, and 9, the aperture in the closed end (3) of the tubular housing (1) may include additional means of securing the initiating means (12) in place which may include a hollow cylinder (15) extending from the aperture, where the hollow of said cylinder aligns with the aperture and may retain and secure a portion of the initiating means. The hollow cylinder may also be threaded about its exterior surface and may be slotted and a non-sparking mechanical fastener, such as a nylon or plastic nut (17) may be used to tighten the threeded and slotted cylinder about the initiating means.

An initiator means (12) is provided as a means of detonating the explosive (11). The means of initiation (12) may be detonation cord, shock tube, blasting caps, electric detonators, etc. The initiation means (12) may be a detonation train, such as a blasting cap, to detonation cord, to a lead pellet to the main explosive charge. However each explosive interface offers the potential for failure to propagate the explosive wave. In particular, air gaps between a lead pellet and explosive (11) and a detonation cord and lead pellet may lead to detonation failures. In an alternate embodiment, an electric blasting cap may be embedded within the explosive (11), thereby simplifying the explosive train and improving reliability.

As shown in FIG. 2, an initiating means (12), which is inserted in the aperture in the closed end (3) of the tubular housing (1) may be substantially flush with the inside surface of the closed end (3), or the initiating means (12) may advantageously protrude into the interior of the tubular housing (1), allowing more contact area with the explosive. If the initiating means (12) protrudes into the explosive, and is thus to be embedded in the explosive, an appropriately shaped well (14) in the explosive, proximate to the aperture (13), should be provided. (See, FIG. 2). This well (14) can be formed, for example either when packing the explosive, by having a temporary rod in place during explosive pressing (i.e. packing around the rod), or by removal of explosive after packing, by mean such as drilling with a non-reactive drill bit. If a temporary rod is used during explosive loading, extra care may be required to insure complete packing around the plug for the initiating means (12).

Although the systems and methods of the present disclosure have been described with reference to exemplary embodiments thereof, the present disclosure is not limited thereby. Indeed, the exemplary embodiments are implementations of the disclosed systems and methods are provided for illustrative and non-limitative purposes. Changes, modifications, enhancements and/or refinements to the disclosed systems and methods may be made without departing from the spirit or scope of the present disclosure.

What is claimed is:

1. An anti-mine device that is small and light enough to be utilized by small to medium scale robots, which device projects a dispersion pattern of fragments to cover at least a 3 to 4 inch radius circle for neutralizing antipersonnel mines that are buried within the overburden, comprising:

a generally tubular housing, having an open front end opposed to a generally closed rear end, and a support, wherein said support extends the housing at least about 3 to 4 inches above the center of a mine;

the tubular housing containing a mass of about 125 to about 190 grams of plastic explosive, which mass of explosive has a front end and a rear end;

the mass of plastic explosive filling said tubular housing such that the rear end of the mass of plastic explosive is adjacent to the generally closed rear end of the housing and the front end of the plastic explosive is proximate to the open front end of the housing;

a generally circular gas check plate having a front side and rear side, an array of generally spherical hard fragments, located along front side of said check plate;

wherein the generally spherical hard fragments are each about ⅛ to about ⅜ inches in diameter;

the gas check plate and the array of fragments being encased in a matrix of plastic material, wherein said encasing matrix forms a generally cylindrical puck having a front side and a rear side, wherein the generally circular gas check plate is located along the rear side of said puck and the array of fragments located along the front side of said puck:

wherein, the puck is of a diameter such that it force fits within the inner diameter of the tubular housing, with the rear side of said puck contacting the front end of the mass of plastic explosive and the front side of said puck being proximate to the open front end of said housing; and wherein, the rear end of the said generally closed end of said housing has a single channel therethrough; wherein an initiator contacts the plastic explosive and initiates detonation of said plastic explosive;

whereby, when the open front end of the housing is aligned with a mine and the mass of explosive is detonated, the spherical fragments will be projected at a velocity of between approximately 500 and 1,400 meters/second, without spalling, and will penetrate the overburden, and penetrate, and neutralize the mine, while minimizing the likelihood of causing a sympathetic detonation of any other nearby mines.

2. The anti-mine device of claim 1, wherein, the generally spherical hard fragments are each about ¼ inch in diameter.

3. The anti-mine device of claim 1, wherein, the generally circular gas check plate is manufactured of a metal selected from the group consisting of copper and aluminum.

4. The anti-mine device of claim 1, wherein, the generally circular gas check plate is flat.

5. The anti-mine device of claim 1, wherein, the generally circular gas check plate is convex with respect to the mass of plastic explosive filling said tubular housing.

6. The anti-mine device of claim 1, wherein, there are from about 40 to 50 generally spherical hard fragments located within the array thereof.

7. The anti-mine device of claim 1, wherein, there is a layer of shock attenuation material along the rear side of the gas check plate, which material is encapsulated within the same matrix of plastic material that encases the gas check plate and the array of fragments to form the puck.

8. The anti-mine device of claim 7, wherein the layer of shock attenuation material comprises polystyrene.

9. The anti-mine device of claim 1, wherein the mass of plastic explosive filling said tubular housing is from 170 to 190 grams.

10. The anti-mine device of claim 1, wherein the plastic explosive is selected from the group consisting of C4, PE4, and Semtex.

11. The anti-mine device of claim 1, wherein the generally tubular housing is manufactured of a material selected from the group consisting of plastic, phenolic, fiberglass, rubber, foam, paper, cardboard, wood, fiber-board, polyoxybenzilmethylenglycolanhydride, reinforced resins, or ceramics.

12. The anti-mine device of claim 1, wherein the generally tubular housing has an inner diameter of about 1.75 to about 2 inches.

13. The anti-mine device of claim 1, wherein the generally tubular housing is about 2 to about 4 inches in length.

14. The anti-mine device of claim 1, wherein the generally tubular housing is about 2.5 inches in length.

15. The anti-mine device of claim 1, wherein the generally spherical hard fragments penetrate from about 2.5 to about 5 inches into the overburden.

16. The anti-mine device of claim 1, wherein the fragments will expel the overburden within which the anti-personnel mine is buried, such that the mine is exposed.

17. The anti-mine device of claim 1, wherein the support provide a standoff of at least 5 inches.

18. The anti-mine device of claim 1, wherein the support consists of three or more legs which extend from near the end of the tubular housing proximate to the open front end thereof.

* * * * *